US006624131B2

(12) United States Patent
Murphy et al.

(10) Patent No.: US 6,624,131 B2
(45) Date of Patent: Sep. 23, 2003

(54) WRINKLE REDUCTION LAUNDRY PRODUCT COMPOSITIONS

(75) Inventors: Dennis Stephen Murphy, Wykoff, NJ (US); Michael Orchowski, Nutley, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/995,131

(22) Filed: Nov. 27, 2001

(65) Prior Publication Data

US 2003/0109396 A1 Jun. 12, 2003

(51) Int. Cl.[7] ..... C11D 17/00

(52) U.S. Cl. ..... 510/356; 510/360; 510/437; 510/466; 510/475; 510/513

(58) Field of Search ..... 510/327, 360, 510/573, 466, 475, 331, 437, 353, 356

(56) References Cited

U.S. PATENT DOCUMENTS

| | | | | |
|---|---|---|---|---|
| 3,619,115 A | | 11/1971 | Diehl et al. | |
| 3,970,594 A | | 7/1976 | Claybaugh | |
| 4,261,868 A | | 4/1981 | Hora et al. | |
| 4,322,308 A | | 3/1982 | Hooper et al. | |
| 4,639,321 A | | 1/1987 | Barrat et al. | |
| 4,652,394 A | * | 3/1987 | Inamorato et al. | 252/174.17 |
| 4,911,852 A | | 3/1990 | Coffindaffer et al. | |
| 4,959,179 A | | 9/1990 | Aronson et al. | |
| 5,089,163 A | | 2/1992 | Aronson et al. | |
| 5,147,576 A | | 9/1992 | Montague et al. | |
| 5,205,957 A | | 4/1993 | Van de Pas | |
| 5,952,286 A | * | 9/1999 | Puvvada et al. | 510/417 |
| 6,271,185 B1 | | 8/2001 | Kodali et al. | |

FOREIGN PATENT DOCUMENTS

| | | |
|---|---|---|
| DE | 2 350 543 | 4/1974 |
| DE | 39 22 006 A1 | 1/1991 |
| EP | 0 242 919 | 10/1987 |
| EP | 0 363 346 | 4/1990 |
| EP | 0 569 847 A1 | 5/1993 |
| GB | 1 498 692 | 1/1978 |
| JP | 3 269 165 A | 4/1990 |
| WO | 93/24603 | 12/1993 |
| WO | 96/34092 | 10/1996 |
| WO | 00/24857 | 5/2000 |

OTHER PUBLICATIONS

International Search Report PCT/EP 02/12866 dated Mar. 10, 2003, 5 pp.
Thomson Derwent WPI acct. No. 1991–008218/199102 abstract of DE 39 22 006 –1 page.
Thomson Derwent WPI acct. No. 1974–11481V/1974072 abstract of DE 23 50 543–1 page.
Thomson Derwent WPI acct. No. 1993–361108/199346 abstract of EP 0 569 847 –1 page.
European Abstract No. XP–002232219 of JP 3 269 165 A –1 page.

* cited by examiner

*Primary Examiner*—Necholus Ogden
(74) *Attorney, Agent, or Firm*—Alan A. Bornstein

(57) ABSTRACT

A laundry detergent composition and method of laundering clothes is disclosed which relates to the inclusion of one or more wrinkle reducing ingredients in a laundry detergent product. The benefits are delivered to the laundered item during the cleaning step and, therefore, reduces the need for further wrinkle reducing steps when the items are taken from the dryer or after hang drying.

8 Claims, No Drawings

WRINKLE REDUCTION LAUNDRY PRODUCT COMPOSITIONS

BACKGROUND OF THE INVENTION

1. Field of the Invention

The present invention relates to a laundry detergent composition suitable for laundering textiles, such as clothing, linens and the like. In particular, it relates to a laundry detergent composition that causes textile wrinkles to be eliminated or minimized after the cleaning and drying process.

2. The Related Art

Mechanical wrinkle reduction techniques, such as heat and pressure (for example, ironing), have been used but can be time consuming and inconvenient. Known attempts to reduce wrinkles by means of chemical ingredients in the wash include the use of zwitterionic surfactants, aminosilicones, curable aminosilicones, cellulase enzymes and alkyl amides. However, each of these ingredients have one or more drawbacks. For example, zwitterionic surfactants are believed to work best in cold water. Aminosilicones can cause yellowing and can be difficult to formulate. Curable aminosilicones require the heat of an iron to reduce wrinkles. Cellulase enzymes generally require several wash cycles before anti-wrinkle benefits become noticeable. Alkyl amides are not very effective relative to other wrinkle reducing agents.

Therefore, there is a need for an effective and efficient means for eliminating or reducing wrinkles in textiles during the laundering process. To be effective and efficient, the ingredient should preferably work across a broad range of water temperatures, not require the use of an iron, have little to no discoloration effect on the laundered item and/or provide a noticeable wrinkle reducing benefit after relatively few wash cycles.

SUMMARY OF THE INVENTION

The present application relates to the inclusion of one or more wrinkle reducing ingredients in a laundry detergent product. The benefits are delivered to the laundered item during the cleaning step and, therefore, reduces the need for further wrinkle reducing steps when the items are taken from the dryer or after hang drying.

The inventive, hydrophilically modified oils that facilitate the benefit of wrinkle reduction are believed to lubricate fiber surfaces. By lubricating the fiber surfaces of garments, for example, the fibers slide more easily relative to each other and are less likely to entangle, resulting in fewer wrinkles. The inventive fiber lubricants disclosed herein have the ability to noticeably reduce the number of wrinkles. The inventive fiber lubricants also overcome one or more of the above noted disadvantages of prior wrinkle reducing agents or methods.

While it is known that lubricants can be used to reduce wrinkles in textiles, it was surprisingly found that these inventive materials work from a main wash detergent. More particularly, main wash detergents are highly diluted and are subject to one or more rinse cycles. Such high dilution and rinsing would be expected to diminish or eliminate the desired wrinkle reduction effect of the lubricant.

DETAILED DESCRIPTION

Suitable hydrophilically modified plant, animal, and synthetic triglyceride oils and waxes have been identified for wrinkle reduction benefits when included in known liquid detergent compositions according to the present invention. Such suitable plant derived triglyceride materials include sulfate and sulfonate free hydrophilically modified triglyceride oils, e.g. carboxylated, alkoxylated, esterified, saccharide modified, and amide derivatized oils, tall oils and derivatives thereof, and the like. Suitable animal derived triglyceride materials include hydrophilically modified fish oil, tallow, lard, and lanolin wax, and the like. Sulfated or sulfonated animal and synthetically derived triglyceride oils are also included as examples of the present invention. However, sulfated and sulfonated plant derived trigyceride oils.

Typically such derivatives can be prepared using art recognized techniques via reaction with one or more hydroxyl groups, unsaturated sites, or a combination thereof in the oil or wax. Other suitable water soluble or dispersible non-sulfated or non-sulfonated triglyceride oil derivatives may be prepared by transesterifcation using art recognized techniques with e.g. alkanolamines such as triethanolamine and/or its alkoxylated derivatives. Suitable methods for transesterifying triglyceride oils may be found in e.g. U.S. Pat. No. 6,271,185 issued to Kodall et al. on Aug. 7, 2001 which is incorporated herein in its entirety. Other suitable water soluble or dispersible non-sulfated or non-sulfonated triglyceride oil derivatives having polyunsaturated fatty acids include adducts which are conjugated and then modified via Diels-Alder addition with acrylic acid, fumaric acid, maleic anhydride and the like.

Various levels of derivatization may be used provided that the derivatization level is sufficient for the oil or wax derivatives to become water soluble or dispersible so as to exert a wrinkle reduction effect during laundering of fabrics with a detergent containing the oil or wax derivative.

Suitable alkoxylated plant and animal derived and synthetic triglyceride oil derivatives may include ethoxylated, propoxylated, or a combination thereof as illustrated in the following structure:

$$(1)\ \mathrm{TG}\text{-}((\mathrm{OCH_2CH_2O})\times(\mathrm{OCHCH_3CH_2})_y\mathrm{OR})_n$$

TG=Triglyceride radical; n=1, 2 or 3; R=H; $C_{1-C20}$ alkyl, $C_1$–$C_{20}$ alkenyl, $C_1$–$C_{20}$ alkylaryl, aryl, or heterocyclic; either substituted or unsubstituted. x=an integer from 1 to 50; y=an integer from 0 to 50; x and y groups may be in either a random or a blocked arrangement.

Suitable saccharide modified plant and animal derived and synthetic triglyceride oil derivatives may include monosaccharides, disaccharides and polysaccharides e.g. sucrose, glucose, maltose and the like, or a combination thereof as illustrated in the following structure:

$$(2)\ \mathrm{TG}\text{-}(\mathrm{Saccharide})_n$$

TG=Triglyceride radical; n=1, 2 or 3.

Suitable carboxylated plant and animal derived and synthetic triglyceride oil derivatives may include compounds as illustrated by the following structure:

$$(3)\ \mathrm{TG}\text{-}(\mathrm{C(O)(CH_2)_zC(O)O\ M})_n$$

TG=Triglyceride radical; n=1, 2 or 3; z is an integer from 1 to 20, preferably from 1 to 5. M is H or a cation such as Na, K, Li, $NH_4$, Ca, or Mg and the like.

Suitable peptide modified plant and animal derived and synthetic triglyceride oil derivatives may include monopeptides, dipeptides, and polypeptides as illustrated by the following structure:

(4) TG–(peptide(s))$_n$

TG=Triglyceride radical; n=1, 2 or 3.

Suitable commercially available ethoxylated and alkoxylated derivatives include: castor oil products such as Stepantex CO-30, Stepantex CO-36 and Stepantex CO-40 ethoxylated castor oil products and Stepantex HCO-5 a hydrogenated castor oil alkoxylate, the Ethox CO line of products (ethoxylated castor oil), and the like, from Ethox Chemicals (Greenvile, S.C.) and, the Hetoxide C line of products (ethoxylated castor oil), and the like, from Heterene Chemical (Paterson, N.J.); tall oil derivatives such as Ethofat 242/25, an ethoxylated tall oil, and the like, available from Akzo Nobel; and, lanolin derivatives such as Lan-Aqua-Sol 4:50 (lanolin ethoxylate) and Fancol HL-20 (a hydrogenated lanolin ethoxylate), and the like.

Suitable triglyceride oil derivatives may be prepared by esterification to a sufficient level for the triglyceride oil derivatives to become water soluble or dispersible so as to exert a wrinkle reduction effect during laundering of fabrics with a detergent containing the esterified triglyceride oil derivative. Any suitable compound may be used to esterify the triglyceride oil including linear, alpha-omega dicarboxylic acids.

Other suitable derivatives include Freedom STW-80 (sulfated tallow), Solocod G (sulfated fish oil), and Freedom SLO-75 (sulfated lard oil), and the like, available from Noveon (Cleveland, Ohio); Lowenol NZB (sulfated lanolin) , and the like, available from Lowenstein and Sons (Brooklyn, N.Y.); and, Fancol ACEL (acylated lanolin), and the like, available from Thornley Co (Wilmington, Del.).

One or more of the molecules/compounds from the above-identified classes of inventive hydrophilically modifed triglyceride oils are preferably included in known detergent compositions in an effective amount sufficing to reduce the occurrence of wrinkles as compared to clothing laundered and dried in a similar manner with a detergent composition that excludes the wrinkle reducing agents. An effective amount of the wrinkle reducing Ingredient is preferably from about 0.5 wt % to about 15 wt % and most preferably from about 1 wt % to about 7 wt %. Suitable liquid detergent compositions are described, for example, in U.S. Pat. Nos.: 4,261,868; 4,322,308; 4,959,179; 5,089,163; 5,147,576; and 5,205,957, all of which are incorporated herein by reference.

An additional advantage of the above-identified wrinkle reducing ingredients is that the molecules/compounds do not have a net positive charge in a neutral or alkaline medium, i.e. a medium having a pH greater than or equal to about 6.5. Lack of a net positive charge makes their inclusion in liquid detergents containing anionic surfactants much easier. More specifically, they are less likely to precipitate with negatively charged surfactants.

Except in the operating and comparative examples, or where otherwise explicitly indicated, all numbers in this description indicating amounts of material ought to be understood as modified by the word "about".

The following examples will more fully illustrate the embodiments of this invention. All parts, percentages and proportions referred to herein and in the appended claims are by weight unless otherwise illustrated. Physical test methods are described below:

TEST METHOD AND EXAMPLES

Wrinkle reduction may be measured by using the American Association of Textile Chemists and Colorists' (AATCC) method# 124, Appearance of Fabrics after Repeated Home Laundering in order to assess the benefits of the invention. In this method, four cloth types (silk, rayon, cotton, and linen) are washed, dried and stored in a well defined way. The dried cloths are then evaluated for wrinkle content by comparison with wrinkle smoothness replicas which can be purchased from AATCC. Factors such as the light used, the angle of the cloths and replicas to the light, and the background are carefully controlled and described in the method. There are six replicas with values of 1, 2, 3, 3.5, 4, and 5 with 5 being perfectly smooth and 1 being very wrinkled. Three trained observers are asked to give a value of 1–5, to the nearest 0.5 unit, to each cloth based on which replica it most closely resembles. The results are totaled and averaged over the three observers for each cloth type. According to the method, a difference of greater than 0.17 between the results for two products indicates there is a significant difference at the 95% confidence level. A difference of greater than or equal to 0.25 indicates a significant difference at the 99% confidence level.

The following compositions show preferred ranges of ingredients in accordance with the present disclosure. Compositions 1–3 represent liquid laundry detergents. Compositions 4 and 5 represent powdered and tableted detergent compositions respectively.

EXAMPLES 1–3

The following three liquid detergent compositions containing an inventive wrinkle reduction ingredient may be produced:

Composition 1 (Liquid Detergent A)

| Ingredient - Chemical Name | Percent in Formula (Based on 100% Active Raw) |
|---|---|
| Ethoxylated nonionics | 4.0–15.0 |
| Sodium alkyl ethoxy sulfate | 7.0–25.0 |
| Alkybenzene sulfonic acid | 4.0–15.0 |
| Sodium hydroxide | 0.3–2.5 |
| Propylene glycol | 2.0–10.0 |
| Sorbitol | 2.0–10.0 |
| Sodium tetraborate pentahydrate | 2.0–10.0 |
| Sodium citrate dihydrate | 1.5–100 |
| Wrinkle reducing agent* | 0.5–10 |
| Coconut fatty acid | 0.4–2.5 |
| Fluorescent whitening agent | 0–0.6 |
| Antiredeposition agent | 0–1.5 |
| Protease enzyme | 0–1.5 |
| Lipase enzyme | 0–2.0 |
| Monoethanolamine | 0.1–1.5 |
| Fragrance | 0.1–1.0 |
| Water | to 100 |

-continued

Composition 1 (Liquid Detergent A)

| Ingredient - Chemical Name | Percent in Formula (Based on 100% Active Raw) |
|---|---|
| Selected from: Ethox CO-16 (POE–16 castor oil) and Ethox CO–25 (POE–25 castor oil) both available from Ethox Chemical CO.; Freedom STW-80 (sulfated tallow), Solocod G (sulfated fish oil), and Freedom LO-75 (sulfated lard oil) available from Noveon; Lowenol NZB (sulfated lanolin) available from Lowenstein and Sons; Ethofat 242/25 (ethoxylated tall oil) available from Akzo Nobel; Lan-Aqua-Sol 4:50 (lanolin ethoxylate), Fancol HL-20 (hydrogenated lanolin ethoxylates), and Fancol ACEL (acylated lanolin) available from Thornley CO. | |

Composition 2 (Liquid Detergent B)

| Ingredient - Chemical Name | Percent in Formula (Based on 100% Active Raw) |
|---|---|
| Ethoxylated nonionics | 3.5–20.0 |
| Alkylbenzene sulfonic acid | 4.0–30.0 |
| Sodium hydroxide | 1.0–10.0 |
| Wrinkle reducing agent* | 0.5–10.0 |
| Sodium xylene sulfonate | 0.75–8.0 |
| Stearic acid | 0.01–0.5 |
| Sodium silicate | 2.0–12.0 |
| Fluorescent whitening agent | 0.04–0.4 |
| Fragrance | 0.1–1.0 |
| Water | To 100 |

*Selected from: Ethox CO-16 (POE-16 castor oil) and Ethox CO-25 (POE-25 castor oil) both available from Ethox Chemical Co.; Ethofat 242/25 (ethoxylated tall oil) available from Akzo Nobel; Lan-Aqua-Sol 4:50 (lanolin ethoxylate) and Fancol HL-20 (hydrogenated lanolin ethoxylates) available from Thornley Co.

Composition 3 (Liquid Detergent C)

| Ingredient - Chemical Name | Percent in Formula (Based on 100% Active Raw) |
|---|---|
| Ethoxylated nonionics | 3.5–20.0 |
| Alkylbenzene sulfonic acid | 4.0–30.0 |
| Sodium hydroxide | 0.3–10.0 |
| Sodium xylene sulfonate | 0.75–8.0 |
| Sorbitol | 1.0–10.0 |
| Stearic acid | 0.01–0.5 |
| Sodium tetraborate pentahydrate | 1.0–10.0 |
| Sodium citrate dihydrate | 0–5.0 |
| Wrinkle reducing agent* | 0.5–10.0 |
| Fluorescent whitening agent | 0.1–0.6 |
| Protease enzyme | 0–1.5 |
| Lipase enzyme | 0–2.0 |
| Fragrance | 0.1–1.0 |
| Water | To 100 |

*Selected from: Ethox CO-16 (POE–16 castor oil) and Ethox CO-25 (POE-25 castor oil) both available from Ethox Chemical Co.; Freedom STW-80 (sulfated tallow), Solocod G (sulfated fish oil), and Freedom SLO-75 (sulfated lard oil) available from Noveon; Lowenol NZB (sulfated lanolin) available from Lowenstein and Sons; Ethofat 242/25 (ethoxylated tall oil) available from Akzo Nobel; Lan-Aqua-Sol 4:50 (lanolin ethoxylate), Fancol HL-20 (hydrogenated lanolin ethoxylates), and Fancol ACEL (acylated lanolin) available from Thornley Co.

Typically one wash with a detergent prepared with and without the inventive wrinkle reducing agent is performed using approximately 110 g of detergent in 17 gallons of water at 95 F.

EXAMPLE 4

The following detergent powder compositions containing an inventive wrinkle reduction ingredient may be produced:

Composition 4 (Detergent Powder)

| Ingredient - Chemical Name | Percent in Formula (Based on 100% Active Raw) |
|---|---|
| Ethoxylated nonionics | 2.0–20.0 |
| Alkylbenzene sulfonic acid | 4.0–20.0 |
| Sodium hydroxide | 1.0–8.0 |
| Sodium aluminosilicate | 15.0–40.0 |
| Sodium carbonate | 15.0–30.0 |
| Sodium sulfate | 10.0–30.0 |
| Sodium silicate | 0.1–3.0 |
| Antiredeposition agent | 0–3.0 |
| Sodium perborate | 0–8.0 |
| Protease enzyme | 0–2.0 |
| Fragrance | 0.1–1.5 |
| Fluorescent whitening agent | 0–2.0 |
| Wrinkle reducing agent* | 0.5–15.0 |
| Water | To 100 |

*Selected from: Ethox CO-16 (POE-16 castor oil) and Ethox CO-25 (POE-25 castor oil) both available from Ethox Chemical CO.; Freedom STW-80 (sulfated tallow), Solocod G (sulfated fish oil), and Freedom SLO-75 (sulfated lard oil) available from Noveon; Lowenol NZB (sulfated lanolin) available from Lowenstein and Sons; Ethofat 242/25 (ethoxylated tall oil) available from Akzo Nobel; Lan-Aqua-Sol 4:50 (lanolin ethoxylate), Fancol HL-20 (hydrogenated lanolin ethoxylates), and Fancol ACEL (acylated lanolin) available from Thornley CO.

Typically one wash with a detergent prepared with and without the inventive wrinkle reducing agent is performed using approximately 50–90 g of powdered detergent in 17 gallons of water at 95 F.

EXAMPLE 5

The following detergent tablet compositions containing an inventive wrinkle reduction ingredient may be produced:

COMPOSITION 5 (Detergent Tablet)

| Ingredient - Chemical Name | Percent in Formula (Based on 100% Active Raw) |
|---|---|
| Ethoxylated nonionics | 2.0–15.0 |
| Alkylbenzene sulfonic acid | 3.0–20.0 |
| Sodium Hydroxide | 1.0–8.0 |
| Sodium aluminosilicate | 15.0–40.0 |
| Sodium carbonate | 15.0–40.0 |
| Sodium sulfate | 2.0–10.0 |
| Sodium Acetate trihydrate | 15.0–40.0 |
| Fluorescent whitener | 0–2.0 |
| Stearic acid | 0.2–2.0 |
| Fragrance | 0.1–2.0 |
| Protease enzyme | 0–2.0 |
| Antiredeposition agent | 0–2.0 |
| Wrinkle reducing agent* | 0.5–15.0 |
| Water | to 100 |

*Selected from: Ethox CO-16 (POE-16 castor oil) and Ethox CO-25 (POE-25 castor oil) both available from Ethox Chemical CO.; Freedom STW-80 (sulfated tallow), Solocod G (sulfated fish oil), and Freedom SLO-75 (sulfated lard oil) available from Noveon; Lowenol NZB (sulfated lanolin) available from Lowenstein and Sons; Ethofat 242/25 (ethoxylated tall oil) available from Akzo Nobel; Lan-Aqua-Sol 4:50 (lanolin ethoxylate), Fancol HL-20 (hydrogenated lanolin ethoxylates), and Fancol ACEL (acylated lanolin) available from Thornley CO.

Typically one wash with a detergent prepared with and without the inventive wrinkle reducing agent is performed using 2 approximately 40 g detergent tablets in 17 gallons of water at 95 F.

The above-identified wrinkle reducing agents may be incorporated in liquid, powdered/granular, semi-solid or paste, and molded solid or tablet compositions. Suitable powdered/granular composition are well known commercially available, for example, under the brand names Wisk (Unilever) and Tide (Procter and Gamble).

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A laundry detergent composition, comprising: at least one water soluble or dispersible triglyceride wrinkle reducing agent selected from hydrophilically modified sulfate free and sulfonate free vegetable oils; said wrinkle reducing agent being present in an amount effective to reduce the occurrence of wrinkles in laundered clothing.

2. The composition according to claim 1, wherein said laundry detergent composition has about 10 to about 60 wt. % of a surfactant.

3. The composition according to claim 1, wherein at least one of the wrinkle reducing agents is present in the composition in the range of about 0.5 wt % to about 15 wt % of the composition.

4. The composition according to claim 1, wherein at least one of the wrinkle reducing agents is present in the composition in the range of about 1 wt % to about 7 wt % of the composition.

5. The composition according to claim 1, wherein the composition is in a form selected from a liquid, powder, paste, granule, or molded solid.

6. The composition according to claim 1 wherein the triglyceride wrinkle reducing agent is ethoxylated triglycerides.

7. A method of reducing the occurrence of wrinkles in laundered clothing, comprising the steps of:

providing a detergent composition including at least one surfactant and at least one wrinkle reducing agent selected from hydrophilically modified non-sulfated and non-sulfonated vegetable oils;

contacting the detergent composition with clothing during a washing procedure; and allowing the clothing to dry; wherein the laundered clothing has fewer wrinkles present than clothing laundered and dried in an identical manner with a detergent composition that excludes the at least one wrinkle reducing agent.

8. The composition according to claim 7 wherein the detergent composition is in a form selected from a liquid, powder, paste, granule, and molded solid.

* * * * *